US008601833B2

(12) United States Patent
Dee et al.

(10) Patent No.: US 8,601,833 B2
(45) Date of Patent: Dec. 10, 2013

(54) SYSTEM TO COLD COMPRESS AN AIR STREAM USING NATURAL GAS REFRIGERATION

(75) Inventors: Douglas Paul Dee, Orefield, PA (US); Donn Michael Herron, Fogelsville, PA (US); Jung Soo Choe, Gwynedd Valley, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 1191 days.

(21) Appl. No.: 11/875,052

(22) Filed: Oct. 19, 2007

(65) Prior Publication Data

US 2009/0100863 A1 Apr. 23, 2009

(51) Int. Cl.
*F25J 1/00* (2006.01)
*F25J 3/00* (2006.01)

(52) U.S. Cl.
USPC ..... 62/648; 62/615; 62/616; 62/643; 62/650

(58) Field of Classification Search
USPC ..... 62/615, 616, 640, 643, 644, 648, 650, 62/651, 654
See application file for complete search history.

(56) References Cited

U.S. PATENT DOCUMENTS

| | | | | |
|---|---|---|---|---|
| 3,339,370 | A * | 9/1967 | Tutton et al. | 62/648 |
| 3,857,251 | A * | 12/1974 | Alleaume | 62/623 |
| 3,886,758 | A * | 6/1975 | Perrotin et al. | 62/651 |
| 4,192,662 | A * | 3/1980 | Ogata et al. | 62/643 |
| 5,137,558 | A | 8/1992 | Agrawal | |
| 5,139,547 | A * | 8/1992 | Agrawal et al. | 62/616 |
| 5,141,543 | A | 8/1992 | Agrawal et al. | |
| 5,220,798 | A * | 6/1993 | Nagamura et al. | 62/656 |
| 5,651,271 | A * | 7/1997 | Fraysse et al. | 62/646 |
| 6,598,408 | B1 | 7/2003 | Nierenberg | |
| 7,228,715 | B2 * | 6/2007 | Brugerolle et al. | 62/643 |
| 2005/0126220 | A1 * | 6/2005 | Ward | 62/625 |

FOREIGN PATENT DOCUMENTS

| | | | |
|---|---|---|---|
| CN | 1873357 | | 12/2006 |
| DE | 10 51 299 | B | 2/1959 |
| DE | 25 53 700 | A1 | 6/1977 |
| FR | 2 077 442 | A | 10/1971 |
| GB | 804944 | A | 11/1958 |
| GB | 928504 | A | 6/1963 |
| GB | 1120712 | A | 7/1968 |
| JP | 49-040353 | A | 4/1974 |
| JP | 53-82687 | A | 7/1978 |
| JP | 53124188 | | 10/1978 |
| JP | 54-162678 | A2 | 12/1979 |
| JP | 57-065900 | A2 | 4/1982 |
| JP | 57-120077 | A | 7/1982 |
| JP | 60-196587 | A | 10/1985 |
| JP | 03-164677 | | 7/1991 |
| JP | 3-164677 | A | 7/1991 |

(Continued)

*Primary Examiner* — Mohammad M Ali
*Assistant Examiner* — Keith Raymond
(74) *Attorney, Agent, or Firm* — Eric J. Schaal

(57) ABSTRACT

An air stream is compressed in multiple stages using refrigeration derived from a refrigerant comprising natural gas for inter-stage cooling. The possibility of natural gas leaking into the air stream is reduced by use of an intermediate cooling medium ("ICM") to transfer the refrigeration from the refrigerant to the inter-stage air stream. The compressed air stream can be fed to a cryogenic air separation unit that includes an LNG-based liquefier unit from which a cold natural gas stream is withdrawn for use as said refrigerant.

17 Claims, 2 Drawing Sheets

(56) References Cited

FOREIGN PATENT DOCUMENTS

| | | | |
|---|---|---|---|
| JP | 61-47781 | A2 | 5/1994 |
| JP | 81-59655 | A2 | 6/1996 |
| JP | 10-267527 | A2 | 10/1998 |
| JP | 2002-318069 | A2 | 10/2002 |
| JP | 2004-108653 | A2 | 4/2004 |

* cited by examiner

SYSTEM TO COLD COMPRESS AN AIR STREAM USING NATURAL GAS REFRIGERATION

BACKGROUND OF THE INVENTION

It is known in the art that the power required to compress a gas can be reduced by compressing the gas in stages in order to allow for cooling of the gas between stages. Eventually a balance is reached where the power savings are offset by the capital cost of dividing the compression step into more and more stages, but depending on the compression duty at issue and the relative costs of power vs. capital, the optimum number of stages will often be several. This is particularly true in the case of compressing an air stream that is fed to a typically sized cryogenic air separation unit ("ASU") wherein the air stream is separated into one or more product streams typically including at least a nitrogen product and an oxygen product, often an argon product, and less often krypton and xenon products.

It is also known in the art that the power savings are proportional to the inter-stage cooling temperature. In particular, cooling to a sub-ambient temperature between stages with a refrigerant such as liquefied natural gas ("LNG") will yield greater power savings than cooling to ambient temperature by using ordinary cooling water as the refrigerant. Once again, eventually a balance is reached where the power savings are offset by the capital cost of the additional refrigeration required to cool the inter-stage gas to a colder and colder temperature. Typically, this balance does not justify the use of anything colder than ambient temperature cooling water. A notable exception however is in the context of an ASU located near an LNG terminal. In such a case, the cost of the LNG is often low enough to not only justify the use of LNG, but to also justify as much LNG as is required to cool the inter-stage air stream to a temperature just above the freezing point of the contaminants contained in the air stream, particularly water and carbon dioxide.

As used herein (and as generally referred to in the industry), "cold compressing" shall mean compression of a gas that is at a sub-ambient temperature at the inlet of a compressor stage. (Contrast this term with "warm compressing" which is the industry term for compression of a gas that is at approximately ambient temperature or above ambient temperature at the inlet of a compressor stage.) Also as used herein, "natural gas refrigeration" shall mean either (i) refrigeration in the form of LNG or (ii) refrigeration in the form of a cold (i.e. a temperature below ambient, especially well below ambient) natural gas, especially the cold natural gas that results from vaporized, but only partially warmed, LNG. For example, the cold natural gas is at a temperature of −20° C. to −120° C., preferably −40° C. to −100° C.

The present invention relates to a system that uses natural gas refrigeration to cold compress an air stream, especially an air stream which is subsequently fed to an ASU. The art teaches such a system. See for example FIG. 1 of Japanese Patent Application 53-124188 by Ishizu (hereafter "Ishizu") and U.S. Pat. No. 3,886,758 by Perrotin et al. (hereafter "Perrotin").

Ishizu refers to a prior art cryogenic air separation process (see FIG. 1) in which LNG is used to provide inter-stage cooling during compression of wet feed air for an ASU incorporating a distillation column system and teaches that the problem of moisture and carbon dioxide freezing during the inter-stage cooling in that process can be obviated by using the LNG to remove heat generated by compression of dry feed air that has been cooled to about −150° C. instead of for the inter-stage cooling (see FIG. 2). The LNG cools the compressed air back to about −150° C. and the resultant cooled compressed air is subsequently cooled to about −170° C. before feeding to the distillation column system.

Perrotin discloses a cryogenic air separation process in which LNG is used to provide condensation duty to a compressed nitrogen product stream from a distillation column system to provide a reflux stream to the distillation column system. Optionally, LNG also is used to provide inter-stage cooling of dried air during feed air compression.

A common concern in Ishizu and Perrotin is the exposure to a scenario where a defect in the heat exchanger used to facilitate the heat exchange between the LNG and inter-stage air stream results in natural gas leaking into the air stream. In particular, such a leak would permit natural gas to enter the distillation column along with the air stream where the natural gas will tend to collect with the oxygen produced in the distillation column and thus create potentially explosive mixtures of oxygen and natural gas. It is an object of the present invention to address this concern.

The art also teaches the use of LNG to cool the air stream after its last stage of compression (hereafter, the "finally compressed air stream"). See for example U.S. Pat. No. 4,192,662 by Ogata et al. (hereafter "Ogata") and US Patent Application 2005/0126220 by Ward (hereafter "Ward").

Ogata discloses a cryogenic air separation process in which LNG is used to cool a circulating nitrogen product stream whereby the stream can be compressed at low temperature and expanded to vaporize oxygen in a rectifying column. In the exemplified process, LNG also is used to provide refrigeration duty to a closed chlorofluorocarbon cycle that in turn provides refrigeration duty to the finally compressed air stream.

Ward discloses a method of adjusting the gross heating value of LNG by adding a condensable gas whereby at least a portion of that gas is condensed by the LNG to provide a blended condensate, which is subsequently vaporized by heat exchange with a heat transfer medium. The heat transfer medium can be used, for example, as a coolant to condition an air feed or other process stream associated with a cryogenic air separation or to cool the condensing gas. In the exemplified process, water and/or ethylene glycol is used as the heat transfer medium and portions thereof are used to cool both finally compressed air stream and a compressed nitrogen product stream.

One notable feature in both Ogata and Ward is the use of an intermediate cooling medium (ICM) to transfer the refrigeration from the LNG to the finally compressed air stream. In particular, the ICM is cooled by indirect heat exchange against the LNG in a first heat exchanger and the resulting cooled ICM is used to cool the finally compressed air stream by indirect heat exchange in a second heat exchanger. In this fashion, Ogata and Ward are protected from a scenario where a leak in the heat exchanger used to cool the finally compressed air stream results in natural gas entering the distillation column. It needs to be clearly noted however that Ogata and Ward do not teach to use the cooled ICM to advantageously cool the air stream between its stages of cold compression.

Finally, the art also teaches the use of cold natural gas for inter-stage cooling during cold compression of nitrogen gas. For example U.S. Pat. No. 5,141,543 by Agrawal et al. (hereafter "Agrawal") refers to a prior art process for liquefaction of nitrogen product streams from a cryogenic air separation in which the nitrogen product streams are cold compressed using a closed chlorofluorocarbon cycle to provide inter-stage cooling and LNG provides refrigeration duty to the chlorofluorocarbon cycle. Additionally, the LNG provides refrigeration for cooling of the finally compressed nitrogen. It needs to be clearly noted that Agrawal does not teach to use the cooled chlorofluorocarbon ICM of the prior art to advantageously provide inter-stage cooling for cold compression of the air stream fed to the ASU.

BRIEF SUMMARY OF THE INVENTION

The present invention is a process for the compression of an air stream in multiple stages that uses refrigeration derived from liquefied and/or cold natural gas for cooling the air stream to a sub-ambient temperature between at least two consecutive stages. In order to reduce the possibility of natural gas leaking into the air stream, an intermediate cooling medium ("ICM") is used to transfer the refrigeration from the natural gas to the inter-stage air stream. In one embodiment of the present invention, the compressed air stream is fed to a cryogenic air separation unit ("ASU") that includes an LNG-based liquefier unit which is synergistically integrated into the process by using a cold natural gas stream withdrawn from the liquefier unit as the natural gas stream used to cool the ICM.

DETAILED DESCRIPTION OF THE INVENTION

Figure 1:
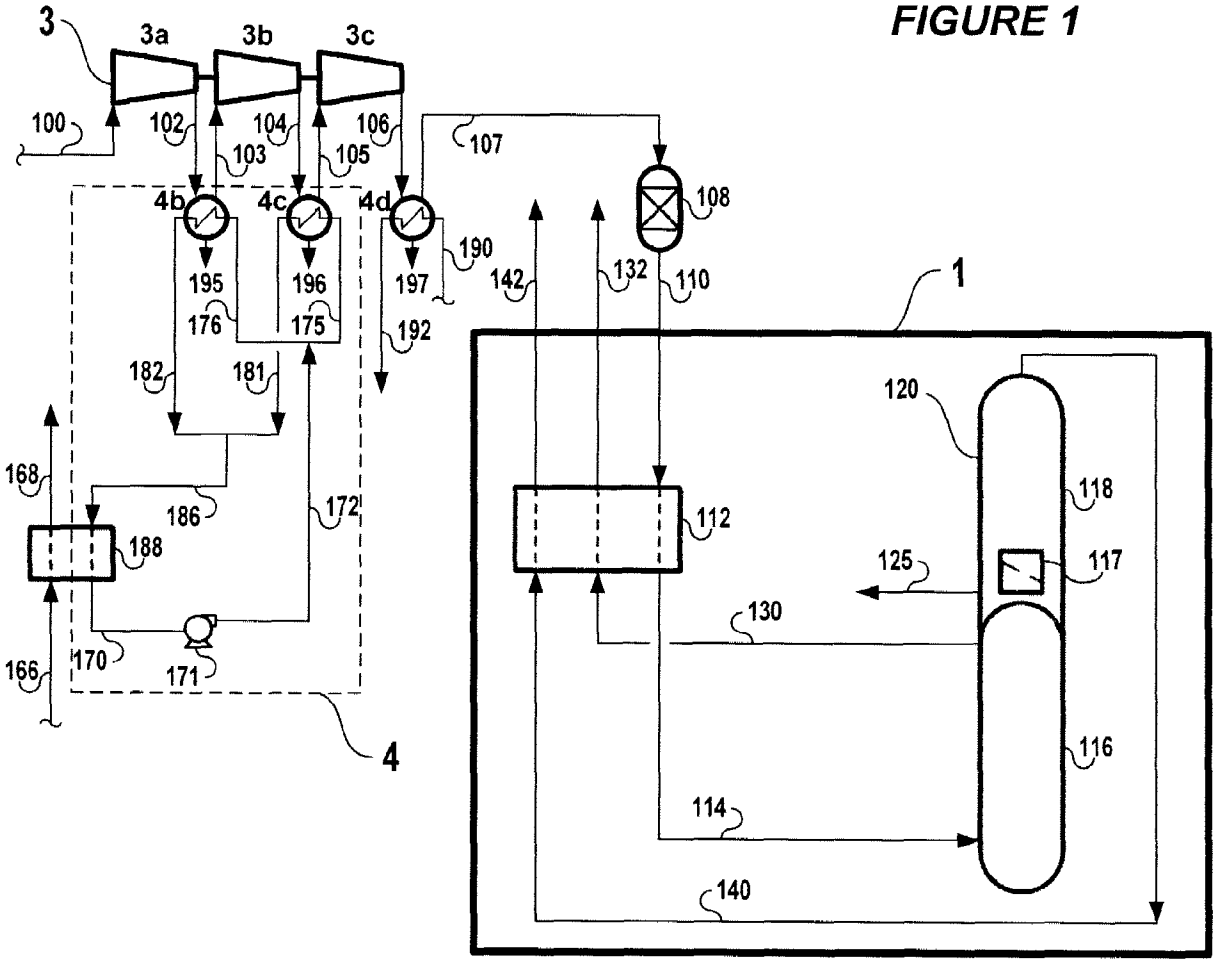
FIG. 1 is a schematic diagram depicting one embodiment of the present invention.

According to one aspect, the present invention provides a process for compressing an air stream comprising:

cooling an intermediate cooling medium ("ICM") stream by indirect heat exchange against a refrigerant stream comprising natural gas;

compressing the air stream using multiple compression stages; and cooling the air stream to a sub-ambient temperature between at least two of the multiple compression stages by indirect heat exchange against the ICM stream.

In a preferred embodiment, the process of the invention comprises:

cooling the intermediate cooling medium ("ICM") stream by indirect heat exchange against a refrigerant stream comprising natural gas;

compressing the air stream in multiple compression stages;

cooling the air stream to a sub-ambient temperature between at least two of the multiple compression stages by indirect heat exchange against the ICM stream;

separating the cooled and compressed air stream, using an air separation unit ("ASU"), into at least one nitrogen product stream and an oxygen product stream;

cooling the at least one nitrogen product stream in a liquefier by heat exchange against the refrigerant stream and, optionally, returning at least a portion of nitrogen product from the liquefier to the ASU; and drawing off at least a portion of the refrigerant stream after heat exchange with the at least one nitrogen product stream and using the at least a portion of the refrigerant stream for the step of cooling the ICM stream.

In a second aspect, the invention provides an apparatus comprising:

a compressor that compresses an air stream in multiple stages, the multiple stages comprising an initial stage, at least one intermediate stage and a final stage;

a plurality of heat exchangers that cool the air stream against an intermediate cooling medium ("ICM") stream, at least one of the plurality of heat exchangers cooling the air stream between the initial stage and the at least one intermediate stage and at least one of the plurality of heat exchangers cooling the air stream between the at least one intermediate stage and the final stage;

an air separation unit ("ASU") that separates the air stream into at least one nitrogen product stream and at least one oxygen product stream; and a liquefier that liquefies the at least one nitrogen product stream by heat exchange against a natural gas stream;

wherein the ICM stream is cooled by heat exchange against at least a portion of the natural gas stream.

When the multiple compression stages comprise an initial stage, one or more intermediate stages and a final stage, it is preferred that the air stream is cooled to a sub-ambient temperature by indirect heat exchange against the ICM stream between each of the one or more intermediate stages.

The air stream also can be cooled to a sub-ambient temperature prior to the first stage of compression and/or after the final stage of compression by indirect heat exchange against the ICM stream.

When the air stream contains water and carbon dioxide prior to the cooling or compressing steps, the sub-ambient temperature should be sufficiently low as to enable at least a portion of the water to condense.

The refrigerant stream can comprise liquefied natural gas ("LNG") and/or non-liquefied natural gas.

Usually, the ICM stream is non-combustible in the presence of oxygen. Preferably it is a liquid with a freezing point temperature below the freezing point of water, especially a mixture of ethylene glycol and water. Alternatively a refrigerant stream that is non-explosive when combined with water, such as selected fluorinated hydrocarbons or mixtures thereof, may be used.

Preferably, the ICM will be in a liquid state upon cooling against the refrigerant stream such that the fluid may be circulated with a pump. However, the ICM can be vaporized upon providing refrigeration to the air compression, in which case the ICM usually would be condensed against the refrigerant stream. Use of a cooling medium that is gaseous after cooling against the refrigerant stream is disadvantageous as compressor power would be needed to circulate the fluid.

The compressed air feed can be separated using an air separation unit ("ASU"), especially a cryogenic ASU, to provide at least one nitrogen product stream and an oxygen product stream. Usually, at least a portion of the carbon dioxide and at least of portion of any remaining water will be removed from the air stream after the compression and before separation and/or the compressed air stream will be cooled to a cryogenic temperature by indirect heat exchange against the at least one nitrogen product stream after compression and before separation. A nitrogen product stream can be liquefied by heat exchange against the refrigerant stream and the ICM stream cooled with at least a portion of the refrigerant stream after said heat exchange. The nitrogen product stream also can be cooled by heat exchange with a portion of the refrigerant stream not used to cool the ICM stream.

Figure 2:
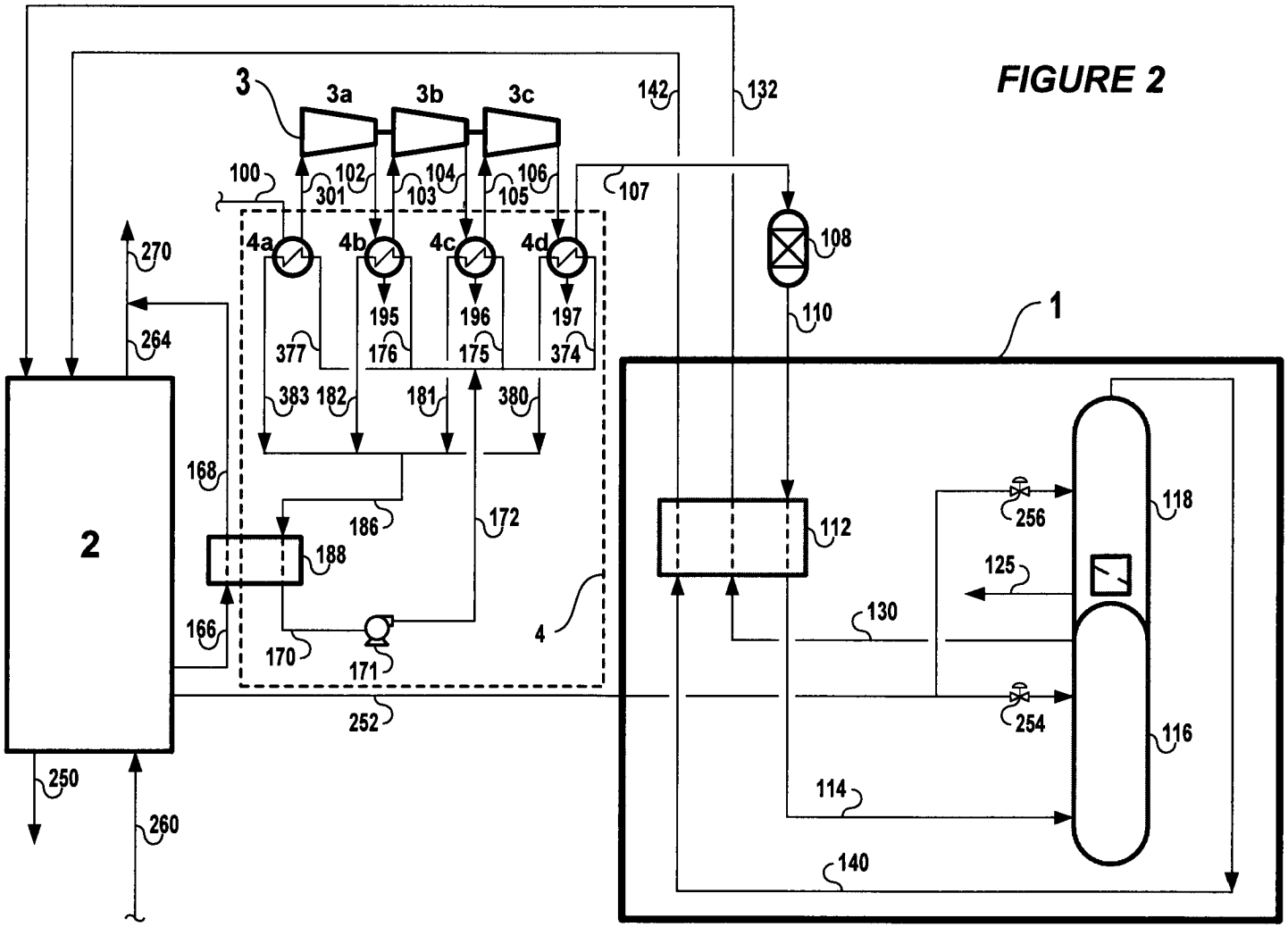
FIG. 2 is a schematic diagram depicting a second embodiment of the present invention.

The present invention is best understood with reference to the non-limiting embodiments depicted in FIGS. 1 and 2, both of which are in the context of compressing an air stream 100 that is fed to a cryogenic air separation unit ("ASU") 1.

Referring now to FIG. 1, air stream 100 is compressed in the initial stage 3*a* of air compressor 3 comprising multiple consecutive stages consisting of the initial stage 3*a*, an intermediate stage 3*b* and a final stage 3*c*. The inter-stage air streams 102 and 104 are each cooled to a sub-ambient temperature with refrigeration derived from a natural gas stream 166. In accordance with the present invention, an intermediate cooling medium ("ICM") is used to facilitate the heat exchange between the natural gas stream 166 and the inter-stage air streams 102 and 104.

The purpose of the ICM is to avoid using a single heat exchanger to facilitate the heat exchange between the natural gas stream 166 and one or more of the inter-stage air streams 102 and 104. In particular, this eliminates the exposure to a scenario where a defect in the single heat exchanger results in natural gas leaking into the inter-stage air stream, and eventually the distillation column system where it will tend to collect with the oxygen produced therein and create potentially explosive mixtures of oxygen and natural gas. In particular, in the case of the typical dual column system comprising a high pressure and low pressure column, the natural gas will tend to migrate down the low pressure column and accumulate in the liquid oxygen that collects at the bottom of the low pressure column. Accordingly, the ICM used in the present invention can be any refrigerant that creates a harmless mixture (i.e., non-explosive) when combined with oxygen. One example of such a refrigerant is a mixture of ethylene glycol and water.

In FIG. 1, the ICM circulates in a closed loop cycle 4. In particular, ICM stream 186 is indirectly heat exchanged against LNG stream 166 in heat exchanger 188 to produce vaporized and warmed natural gas stream 168 and cooled ICM stream 170. To make up for normal pressure losses in the closed loop cycle 4, cooled ICM stream 170 is pumped in pump 171 to produce ICM stream 172 which is split into ICM streams 175 and 176. Inter-stage air stream 102 is cooled to a sub-ambient temperature by indirect heat exchange against ICM stream 176 in heat exchanger 4*b* and the resultant cooled air stream 103 is compressed in the intermediate stage 3*b* of air compressor 3. Similarly, inter-stage air stream 104 is cooled to a sub-ambient temperature by indirect heat exchange against ICM stream 175 in heat exchanger 4*c* and the resultant cooled air stream 105 is compressed in the final stage 3*c* of air compressor 3. The resulting warmed ICM streams 181 and 182 are combined into ICM stream 186 to complete the closed loop. The skilled practitioner will appreciate that pumping of the ICM stream in pump 171 can alternatively occur before the ICM stream is cooled in heat exchanger 4*b*.

The finally compressed air stream 106 is cooled to approximately ambient temperature by indirect heat exchange against cooling water stream 190 in heat exchanger 4*d*. The resulting warmed cooling water is removed as stream 192 while the resultant cooled air stream is removed as stream 107. As a result of the heat exchanges in heat exchangers 4*b*, 4*c*, and 4*d*, a portion of the water contained in air stream 100 is condensed out as streams 195, 196 and 197 respectively. Stream 107 is fed to an adsorption unit 108 in order to remove its carbon dioxide and remaining water content. The resultant air stream 110 is then fed to ASU 1 comprising a main heat exchanger 112 and distillation column system 120.

Air stream 110 is cooled to a cryogenic temperature in the main heat exchanger 112 and the resultant air stream 114 is fed to the distillation column system 120 comprising a high pressure column 116 having a top and a bottom, a low pressure column 118 having a top and a bottom, and a reboiler-condenser 117 thermally linking the high and low pressure columns wherein the air stream is separated into a first nitrogen product stream 130 (removed from the top of the high pressure column 116), a second nitrogen product stream 140 (removed from the top of the low pressure column 118), and an oxygen product stream 125 (removed from the bottom of the low pressure column 118). The nitrogen product streams 130 and 140 are used to cool air stream 110 to a cryogenic temperature by indirect heat exchange in the main heat exchanger 112. The resultant warmed nitrogen product streams are withdrawn from ASU 1 as streams 132 and 142.

FIG. 2 is similar to FIG. 1 except, in order to produce the nitrogen product streams 132 and 142 and/or the oxygen product stream 125 as liquid products, the process further comprises liquefying the nitrogen product streams 132 and 142 with refrigeration provided by an LNG stream 260. In particular, the nitrogen product streams 132 and 142 are fed to a liquefier unit 2 comprising a cold end (the bottom of the liquefier unit 2 based on the orientation of the liquefier unit 2 in FIG. 2), a warm end opposite the cold end, a cold section adjacent to the cold end, a warm section adjacent to the warm end, and an intermediate section located between the cold section and the warm section. The LNG stream 260 is fed to the cold end of the liquefier unit 2 while the nitrogen product streams are fed to the warm end of the liquefier unit 2. The nitrogen product streams 132 and 142 are cold compressed and liquefied in the liquefier unit 2 before being withdrawn from the cold end of the liquefier unit 2 as streams 250 and 252. The LNG stream 260 is vaporized and partially warmed in the cold section of the liquefier unit 2 by indirect heat exchange against the nitrogen product streams 132 and 142.

An initial portion 250 of the liquefied nitrogen product streams is removed from the cold end of the liquefier unit 2 and recovered as liquid nitrogen product stream while, in order to facilitate the recovery of at least a portion of the oxygen product stream 125 as a liquid oxygen product stream, the remaining portion 252 is removed from the cold end and returned to the distillation column system. In particular, an initial part of the remaining portion is reduced in pressure across a valve 254 and returned to the high pressure column 116 while the remaining part of the remaining portion is reduced in pressure across a valve 256 and returned to the low pressure column 118. Alternatively, if the only desired liquid product is liquid nitrogen, stream 252 would be consolidated into stream 250, while if the only desired liquid product is liquid oxygen, stream 250 would be consolidated into stream 252. It should be noted that the invention is not restricted by the manner that stream 252 is utilized in the ASU. For example, stream 252 may be vaporized to provide refrigeration to a process stream within the ASU.

An initial portion of the LNG stream 260 is vaporized and partially warmed in the cold end of the liquefier unit 2 and is further warmed in the warm section of the liquefier unit 2 by further indirect heat exchange against the nitrogen product streams 132 and 142 before being withdrawn from the warm end of the liquefier as stream 264. The remaining portion of the LNG stream 260 vaporized and partially warmed in the cold end of the liquefier unit 2 is withdrawn from the intermediate section of the liquefier unit 2 as a cold natural gas stream and used as the refrigerant stream 166 to cool the ICM in heat exchanger 188. The temperature of stream 166 is typically −20° C. to −120° C., and most preferably −40° C. to −100° C. The warmed natural gas stream 168 from heat exchanger 188 is combined with warmed natural gas stream 264 from the liquefier unit 2 to form stream 270.

One unique feature of this embodiment, as shown in FIG. 2, is the above-noted use of the cold natural gas stream withdrawn from the liquefier unit 2 as the refrigerant stream 166 to cool the ICM in heat exchanger 188. This feature provides the following synergy:

The ability of the present invention's cold compression scheme to use either the "low temperature" refrigeration of LNG as the source of refrigeration (i.e., as per FIG. 1) or the relatively "high temperature" refrigeration of cold natural gas as the source of refrigeration (i.e., as per the present FIG. 2); and The withdrawal of the cold natural gas stream from the liquefier unit 2 justifies the introduction of an additional amount of LNG into the liquefier unit 2. In particular, an amount of LNG having a refrigeration duty equivalent to the refrigeration duty of the withdrawn cold natural gas. This allows a higher degree of cold compression in the liquefier unit 2 (i.e., since the temperature of the LNG refrigeration is lower then the temperature of the cold natural gas refrigeration it replaces), which in turn results in power savings in the liquefier unit 2.

In effect, the ability of the present invention's cold compression scheme to serve as a productive "heat sink" for the cold natural gas withdrawn from the liquefier unit 2 enables a power savings in the liquefier. The example included herein illustrates the power savings achievable by FIG. 2's embodiment of the present invention.

Another significant feature of this embodiment is that the ICM closed loop cycle 4 is also used to cool the air stream 100 before the initial stage of compression 3*a* as well as the finally compressed air stream 106. In particular, air stream 100 is cooled to a sub-ambient temperature by indirect heat exchange against ICM stream 377 in heat exchanger 4*a* and the resultant cooled air stream 301 is compressed in the first stage 3*a* of compressor 3. The resulting warmed ICM streams 383 are combined into ICM stream 186. Similarly, instead of using cooling water to cool the finally compressed air stream 106, the finally compressed air stream 106 is cooled to a sub-ambient temperature by indirect heat exchange against ICM stream 374 in heat exchanger 4*d* where the resultant cooled air in stream 107 is fed to adsorption unit 108 while the resulting condensed water is removed as stream 197. The resulting warmed ICM stream 380 is combined into ICM stream 186.

Using the ICM closed loop cycle 4 to also cool the air streams 100 and 106 as discussed above provides additional advantages. Firstly, at least as it relates to cooling the air stream 100 to a sub-ambient temperature before the initial stage of compression 3*a*, this achieves the same benefits as cold compressing the inter-stage air streams 103 and 104. Secondly, it provides an additional heat sink for the cold natural gas stream 166 withdrawn from the liquefier unit 2 which in turn further increases the power savings in the liquefier unit 2. Finally, it eliminates the need for cooling water in the process and the capital cost of the associated cooling water tower (i.e., for cooling the warmed cooling water back down to ambient temperature by heat exchange against ambient air).

The remaining features in FIG. 2 are common to FIG. 1 and are identified by the same numbers. Although not shown in FIG. 2, the skilled practitioner will appreciate that one or more of heat exchangers 4*a*, 4*b*, 4*c* and 4*d* can be consolidated into a single heat exchanger, optionally along with heat exchanger 188. Similarly, the skilled practitioner will appreciate that the closed ICM loop 4 and/or the cold natural gas stream 166 withdrawn from the liquefier unit 2 can also be used to cool other streams in the process (such as the nitrogen fed to the warm end of liquefier unit 2), optionally in the same single heat exchanger contemplated for heat exchangers 4*a*, 4*b*, 4*c*, 4*d* and 188. Finally, the skilled practitioner will appreciate that to address liquefier start-up or shut-down scenarios, heat exchanger 188 in FIG. 2 could be designed to vaporize and partially warm a fraction of the LNG stream 260 fed to the liquefier unit 2.

The following example illustrates the power savings that is achievable by the present invention.

EXAMPLE

One of the processes presented in this Example uses the "low temperature" refrigeration of LNG as the source of refrigeration for cooling the ICM. In this process, stream 166 consists of a portion of the fresh LNG supply.

Another process, one that uses the relatively "high temperature" refrigeration of cold natural gas as the source of refrigeration for cooling the ICM, is also presented. In this second process, instead of stream 166 consisting of a portion of fresh LNG supply, stream 166 consists of a cold natural gas stream withdrawn from the liquefier unit 2. In effect, the liquefier unit 2 in this process is coupled to the cold compression scheme for the air stream 100.

Both of these processes ("low temperature ICM cooling" and "high temperature ICM cooling") can be compared with a "base case" process that does not at all involve cold compression of the air stream 100.

These different processes were simulated on the basis of producing 1000 metric tons per day of combined liquid oxygen and liquid nitrogen in equal proportions. For these simulations, the temperature of the LNG supply used for "low temperature ICM cooling" is assumed to be 153° C. and the temperature of the cold natural gas stream used for "high temperature ICM cooling" is assumed to be 73° C. The simulations showed that, at the expense of increasing the total required LNG from 1480 metric tons per day to 2280 metric tons per day, the use of the "low temperature" refrigeration of LNG as the source of refrigeration for cooling the ICM reduced the required air compression power from 7.32 MW to 6.96 MW. The simulations further showed that, at the expense of increasing the total required LNG from 1480 metric tons per day to 2140 metric tons per day, the use of the relatively "high temperature" refrigeration of cold natural gas as the source of refrigeration for cooling the ICM not only reduced the required air compression power from 7.32 MW to 6.96 MW, but also reduced the required nitrogen compression power in the liquefier unit 2 from 4.82 MW to 3.54 MW.

It should be noted that, although the de-coupled liquefier in the "low temperature ICM cooling" process sacrifices the power savings achievable by integrating the liquefier as in the "high temperature ICM cooling" process of FIG. 2, a de-coupled liquefier can offer advantages in terms of allowing the continued use of the ASU 1 when the liquefier unit 2 is not operational. This situation might arise whenever the ASU 1 is started up before the liquefier unit 2, or whenever it is desirable to cease net production of liquid nitrogen from the liquefier unit 2 while continuing the production of liquid gaseous oxygen or any other product from the ASU 1.

Aspects and embodiments of the invention include:

#1. A process for compressing an air stream comprising:

cooling an intermediate cooling medium ("ICM") stream by indirect heat exchange against a refrigerant stream comprising natural gas;

compressing the air stream using multiple compression stages; and cooling the air stream to a sub-ambient temperature between at least two of the multiple compression stages by indirect heat exchange against the ICM stream.

#2. The process of #1, wherein the multiple compression stages comprise an initial stage, one or more intermediate stages and a final stage and wherein cooling the air stream comprises cooling the air stream to the sub-ambient temperature by indirect heat exchange against the ICM stream between each of the one or more intermediate stages.

#3. The process of #2, wherein the air stream is cooled to sub-ambient temperature prior to the initial stage by indirect heat exchange against the ICM stream.

#4. The process of #2 or #3, wherein the air stream is cooled to sub-ambient temperature after the final stage of compression by indirect heat exchange against the ICM stream.

#5. The process of any one of #1 to #4, wherein the air stream contains water prior to the cooling or compressing steps and wherein the sub-ambient temperature is sufficiently low as to enable at least a portion of the water to condense.

#6. The process of any one of #1 to #5, wherein the refrigerant stream comprises liquefied natural gas ("LNG").

#7. The process of any one of #1 to #6, wherein the refrigerant stream comprises non-liquefied natural gas.

#8. The process of any one of #1 to #7, wherein the ICM stream comprises a refrigerant that is non-combustible in the presence of oxygen.

#9. The process of #8, wherein the ICM stream comprises a mixture of ethylene glycol and water.

#10. The process of any one of #1 to #9, further comprising separating the air stream, using an air separation unit ("ASU"), into at least one nitrogen product stream and an oxygen product stream.

#11. The process of #10, further comprising cooling the air stream to a cryogenic temperature by indirect heat exchange against the at least one nitrogen product stream after compressing the air stream and before separating the air stream.

#12. The process of #10 or #11, further comprising:

cooling the at least one nitrogen product stream in a liquefier unit by heat exchange against the refrigerant stream; and cooling the ICM stream with at least a portion of the refrigerant stream after heat exchange with the at least one nitrogen product stream.

#13. The process of #12, further comprising cooling of the at least one nitrogen product stream by heat exchange with a portion of the refrigerant stream not used to cool the ICM stream.

#14. A process of #12 or #13 comprising:

cooling an intermediate cooling medium ("ICM") stream by indirect heat exchange against a refrigerant stream comprising natural gas;

compressing the air stream in multiple compression stages;

cooling the air stream to a sub-ambient temperature between at least two of the multiple compression stages by indirect heat exchange against the ICM stream;

separating the air stream, in the ASU, into at least one nitrogen product stream and an oxygen product stream after the cooling and compressing steps;

cooling the at least one nitrogen product stream in a liquefier by heat exchange against the refrigerant stream; and drawing off at least a portion of the refrigerant stream after heat exchange with the at least one nitrogen product stream and using the at least a portion of the refrigerant stream for the step of cooling the ICM stream.

#15. The process of any one of #12 to #14, further comprising returning one of the at least one nitrogen product stream from the liquefier to the ASU after the step of cooling the at least one nitrogen product stream.

#16. The process of any one of #10 to #15, further comprising removing at least a portion of the carbon dioxide and at least of portion of any remaining water from the air stream after compressing the air stream and before separating the air stream.

#17. An apparatus comprising:

a compressor that compresses an air stream in multiple stages, the multiple stages comprising an initial stage, at least one intermediate stage and a final stage;

a first heat exchanger that cools the air stream between the initial stage and the at least one intermediate stage against an intermediate cooling medium ("ICM") stream, a second heat exchanger that cools the air stream between the at least one intermediate stage and the final stage against the intermediate cooling medium ("ICM") stream;

an air separation unit ("ASU") that separates the air stream into at least one nitrogen product stream and at least one oxygen product stream; and a liquefier that liquefies the at least one nitrogen product stream by heat exchange against a natural gas stream;

wherein the ICM stream is cooled by heat exchange against at least a portion of the natural gas stream.

#18. The apparatus of #17, wherein there is more than one intermediate stage and the apparatus comprises respective heat exchangers that cool the air stream between each of the intermediate stages.

#19. The apparatus of #17 or #18, wherein at least one of the at least one nitrogen product stream is returned to the ASU after the at least one nitrogen product steam is liquefied by heat exchange against the natural gas stream.

#20. The apparatus of any one of #17 to #19, comprising a heat exchanger that cools the air stream prior to the initial stage against the intermediate cooling medium ("ICM") stream.

#21. The apparatus of any one of #17 to #20 comprising a heat exchanger that cools the air stream after the final stage against the intermediate cooling medium ("ICM") stream.

The invention claimed is:

1. A process for compressing a feed air stream to an air separation unit ("ASU") including a liquefied natural gas based ("LNG-based") liquefier unit, comprising:

cooling an intermediate cooling medium ("ICM") stream by indirect heat exchange against a refrigerant stream comprising natural gas;

compressing the air stream using multiple compression stages; and cooling the air stream to a sub-ambient temperature between at least two of the multiple compression stages by indirect heat exchange against the ICM stream;

wherein the LNG-based liquefier unit is synergistically integrated into the process by using a cold natural gas stream withdrawn at a temperature of −20° C. to −120° C. from an intermediate location of the liquefier unit as the refrigerant stream used to cool the ICM.

2. The process of claim 1, wherein the multiple compression stages comprise an initial stage, one or more intermediate stages and a final stage and wherein cooling the air stream comprises cooling the air stream to the sub-ambient temperature by indirect heat exchange against the ICM stream between each of the stages.

3. The process of claim 2, wherein the air stream is cooled to sub-ambient temperature prior to the initial stage by indirect heat exchange against the ICM stream.

4. The process of claim 2, wherein the air stream is cooled to sub-ambient temperature after the final stage of compression by indirect heat exchange against the ICM stream.

5. The process of claim 1, wherein the air stream contains water prior to the cooling or compressing steps and wherein the sub-ambient temperature is sufficiently low as to enable at least a portion of the water to condense.

6. The process of claim 1, further comprising separating the air stream, in the ASU, into at least one nitrogen product stream and an oxygen product stream.

7. The process of claim 1, wherein the ICM stream comprises a refrigerant that is non-combustible in the presence of oxygen.

8. The process of claim 1, wherein the ICM stream comprises a mixture of ethylene glycol and water.

9. The process of claim 6, further comprising removing at least a portion of the carbon dioxide and at least of portion of any remaining water from the air stream after compressing the air stream and before separating the air stream.

10. The process of claim 6, further comprising cooling the air stream to a cryogenic temperature by indirect heat exchange against the at least one nitrogen product stream after compressing the air stream and before separating the air stream.

11. The process of claim 10, further comprising: cooling the at least one nitrogen product stream in the liquefier unit by heat exchange against a refrigerant stream comprising liquefied natural gas ("LNG").

12. A process for compressing a feed air stream to an air separation unit ("ASU"), comprising:

cooling an intermediate cooling medium ("ICM") stream by indirect heat exchange against a refrigerant stream comprising natural gas;

compressing the air stream in multiple compression stages;

cooling the air stream to a sub-ambient temperature between at least two of the multiple compression stages by indirect heat exchange against the ICM stream;

separating the air stream, in the ASU, into at least one nitrogen product stream and an oxygen product stream after the cooling and compressing steps;

cooling the at least one nitrogen product stream in a liquefier by heat exchange against the refrigerant stream; and drawing off from an intermediate section of the liquefier a portion of the refrigerant stream at a temperature of −20° C. to −120° C. and using said portion of the refrigerant stream for the step of cooling the ICM stream.

13. The process of claim 12, further comprising, returning one of the at least one nitrogen product stream from the liquefier to the ASU after the step of cooling the at least one nitrogen product stream.

14. An apparatus comprising:

a compressor that compresses an air stream in multiple stages, the multiple stages comprising an initial stage, at least one intermediate stage and a final stage;

a first heat exchanger that cools the air stream between the initial stage and the at least one intermediate stage against an intermediate cooling medium ("ICM") stream, a second heat exchanger that cools the air stream between the at least one intermediate stage and the final stage against the intermediate cooling medium ("ICM") stream;

an air separation unit ("ASU") that separates the air stream into at least one nitrogen product stream and at least one oxygen product stream;

a liquefier that liquefies the at least one nitrogen product stream by heat exchange against a natural gas stream; and a third heat exchanger that cools the ICM stream by heat exchange against a portion of the natural gas stream withdrawn from an intermediate section of the liquefier.

15. The apparatus of claim 14, wherein at least one of the at least one nitrogen product stream is returned to the ASU after the at least one nitrogen product steam is liquefied by heat exchange against the natural gas stream.

16. The apparatus of claim 14, comprising a heat exchanger that cools the air stream prior to the initial stage against the intermediate cooling medium ("ICM") stream.

17. The apparatus of claim 14, comprising a heat exchanger that cools the air stream after the final stage against the intermediate cooling medium ("ICM") stream.

* * * * *